US011965698B2

(12) United States Patent
Huang et al.

(10) Patent No.: US 11,965,698 B2
(45) Date of Patent: Apr. 23, 2024

(54) SLIM HEAT-DISSIPATION MODULE

(71) Applicant: Delta Electronics, Inc., Taoyuan (TW)

(72) Inventors: Shih-Lin Huang, Taoyuan (TW); Ting-Yuan Wu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 17/520,958

(22) Filed: Nov. 8, 2021

(65) Prior Publication Data

US 2022/0057143 A1 Feb. 24, 2022

Related U.S. Application Data

(63) Continuation of application No. 16/144,288, filed on Sep. 27, 2018, now abandoned.

(30) Foreign Application Priority Data

Dec. 28, 2017 (CN) ..... 201711463208.7

(51) Int. Cl.
*F28D 15/02* (2006.01)
*F28D 15/04* (2006.01)

(52) U.S. Cl.
CPC ..... *F28D 15/0233* (2013.01); *F28D 15/0266* (2013.01); *F28D 15/0275* (2013.01); *F28D 15/046* (2013.01)

(58) Field of Classification Search
CPC ..... F28D 15/02; F28D 15/04; F28D 15/0233; F28D 15/0266; F28D 15/0275; F28D 15/046
See application file for complete search history.

(56) References Cited

U.S. PATENT DOCUMENTS 4,274,479 A 6/1981 Eastman
4,931,905 A 6/1990 Cirrito et al.
6,082,443 A * 7/2000 Yamamoto ..... F28D 15/046 174/15.2
2007/0022603 A1 2/2007 Chuang et al.
(Continued)

FOREIGN PATENT DOCUMENTS

CN 201229136 Y 4/2009
CN 103874386 A 6/2014
(Continued)

OTHER PUBLICATIONS

Chinese Office Action of its corresponding CN application No. 201711463208.7 dated Mar. 11, 2020; pp. 1-6.

*Primary Examiner* — Harry E Arant
(74) *Attorney, Agent, or Firm* — MUNCY, GEISSLER, OLDS & LOWE, PC

(57) ABSTRACT

A slim heat-dissipation module is provided. The slim heat-dissipation module includes a first plate, a second plate, a first porous structure, a second porous structure, a first fluid, and a second fluid. The second plate is combined with the first plate to form a first type chamber and a second type chamber, wherein the first type chamber and the second type chamber are sealed and independent, respectively. The first porous structure is disposed in the first type chamber. The second porous structure is disposed in the second type chamber. The first fluid is disposed in the first type chamber. The second fluid is disposed in the second type chamber.

6 Claims, 9 Drawing Sheets

(56) References Cited

U.S. PATENT DOCUMENTS

| | | | | |
|---|---|---|---|---|
| 2011/0174465 | A1* | 7/2011 | Liu | F28D 15/046 165/104.26 |
| 2013/0126133 | A1 | 5/2013 | Wu et al. | |
| 2015/0060010 | A1 | 3/2015 | Bushby | |
| 2018/0213679 | A1* | 7/2018 | Chen | H01L 23/427 |

FOREIGN PATENT DOCUMENTS

| | | | |
|---|---|---|---|
| CN | 104080313 | A | 10/2014 |
| CN | 203859974 | U | 10/2014 |
| CN | 107072105 | A | 8/2017 |

* cited by examiner

SLIM HEAT-DISSIPATION MODULE

CROSS REFERENCE TO RELATED APPLICATIONS

This application is a Continuation of pending U.S. patent application Ser. No. 16/144,288, filed Sep. 27, 2018 and entitled "slim heat-dissipation module", which claims priority of China Patent Application No. 201711463208.7, filed on Dec. 28, 2017, the entirety of which is incorporated by reference herein.

BACKGROUND OF THE INVENTION

Field of the Invention

The present invention relates to a slim heat-dissipation module, and in particular to a slim heat-dissipation module with a vapor chamber structure and a heat pipe structure.

Description of the Related Art

Conventionally, a slim vapor chamber performs a passive thermal equilibrium function, and the slim heat pipe performs an active thermal equilibrium function. When the product needs a passive thermal equilibrium function and an active thermal equilibrium function simultaneously, the slim vapor chamber must overlap the slim heat pipe to form the combined heat-dissipation module. However, the combined heat-dissipation module is thicker and costs more.

BRIEF SUMMARY OF THE INVENTION

In one embodiment, a slim heat-dissipation module is provided. The slim heat-dissipation module includes a first plate, a second plate, a first porous structure, a second porous structure, a first fluid, and a second fluid. The second plate is combined with the first plate to form a first type chamber and a second type chamber, wherein the first type chamber and the second type chamber are sealed and independent, respectively. The first porous structure is disposed in the first type chamber. The second porous structure is disposed in the second type chamber. The first fluid is disposed in the first type chamber. The second fluid is disposed in the second type chamber.

In one embodiment, the sum of the number of first type chambers and the number of second type chambers is three or a positive integer greater than three.

In one embodiment, the number of first type chambers differs from the number of second type chambers.

In one embodiment, the height of the first type chamber differs from the height of the second type chamber.

In one embodiment, the wall thickness of the first type chamber differs from the wall thickness of the second type chamber.

In one embodiment, the first plate or the second plate has at least one through hole, blind hole or protrusion.

In one embodiment, an active heat-dissipation device is disposed out of the first type chamber or the second type chamber.

In one embodiment, the active heat-dissipation device is a fan.

In one embodiment, the first fluid transmits heat by radial diffusion, and the second fluid transmits heat by back-and-forth circulation.

In another embodiment, a slim heat-dissipation module is provided. The slim heat-dissipation module includes a first plate, a second plate, at least one wall, a first porous structure, and a second porous structure. The second plate is combined with the first plate. The wall simultaneously connects to the first plate and the second plate to form a first type chamber and a second type chamber, wherein the first type chamber and the second type chamber are sealed and independent, respectively. The first porous structure is disposed in the first type chamber. The second porous structure is disposed in the second type chamber.

The slim heat-dissipation module of the embodiment of the invention performs a heat dissipation function by active thermal equilibrium and passive thermal equilibrium. The heat dissipation efficiency of the product is improved, and the thickness thereof is reduced. Additionally, the heat pipe structure and the vapor chamber structure are integrated on one single first plate, and the manufacturing cost is decreased.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
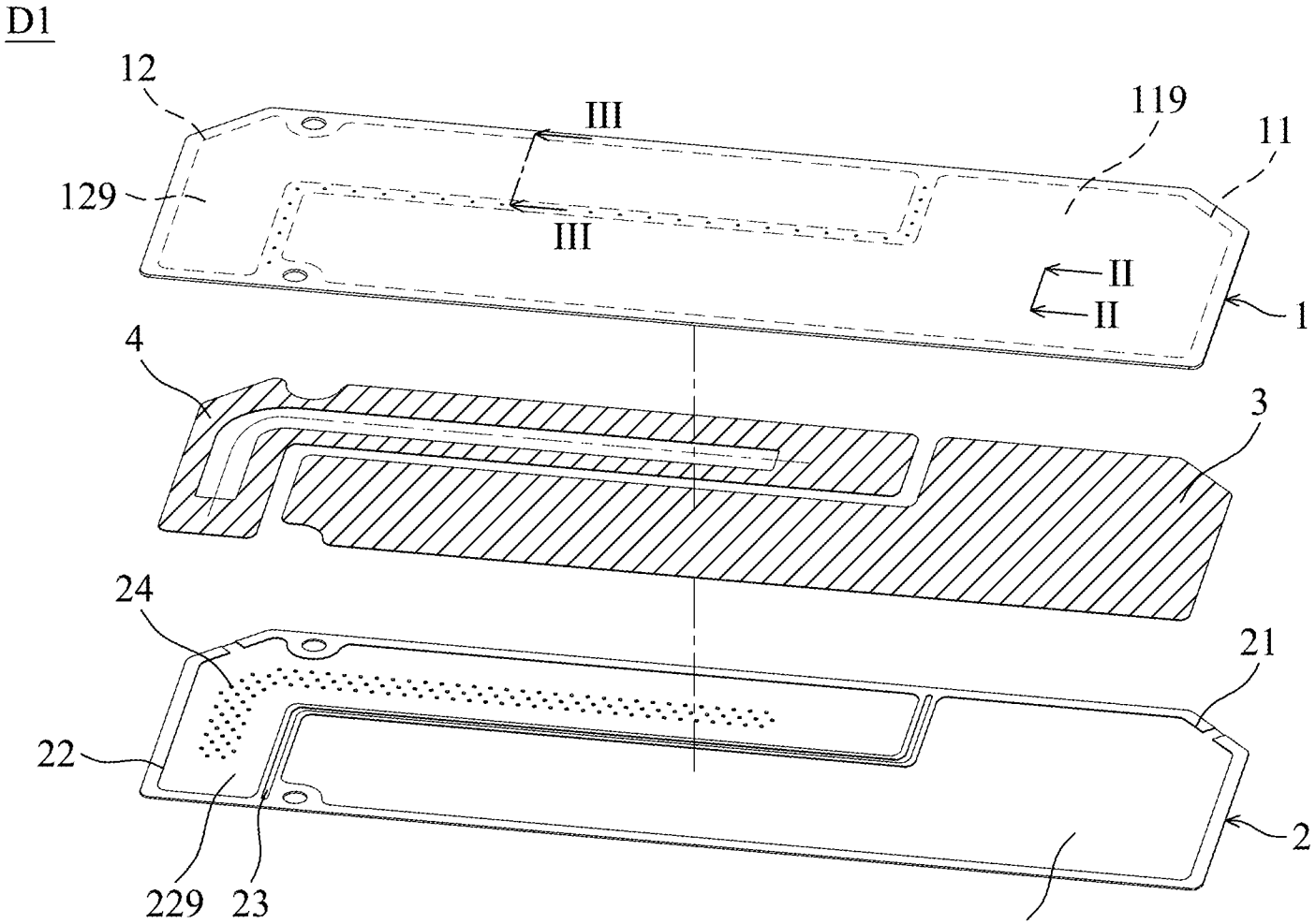
FIG. 1A is an exploded view of a slim heat-dissipation module of a first embodiment of the invention.
Figure 1B:
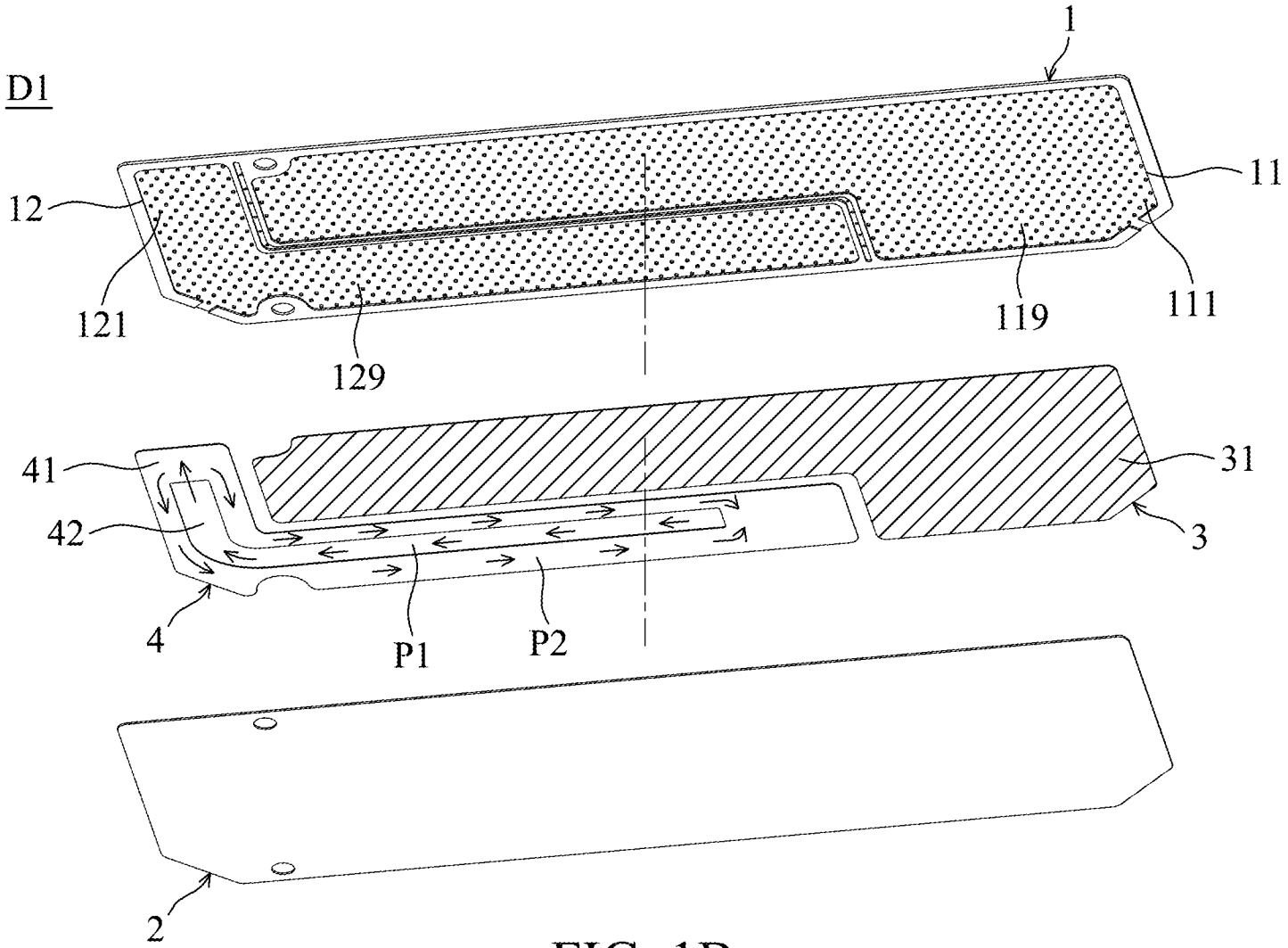
FIG. 1B is an exploded view of the slim heat-dissipation module of the first embodiment of the invention in another view angle.
Figure 2:
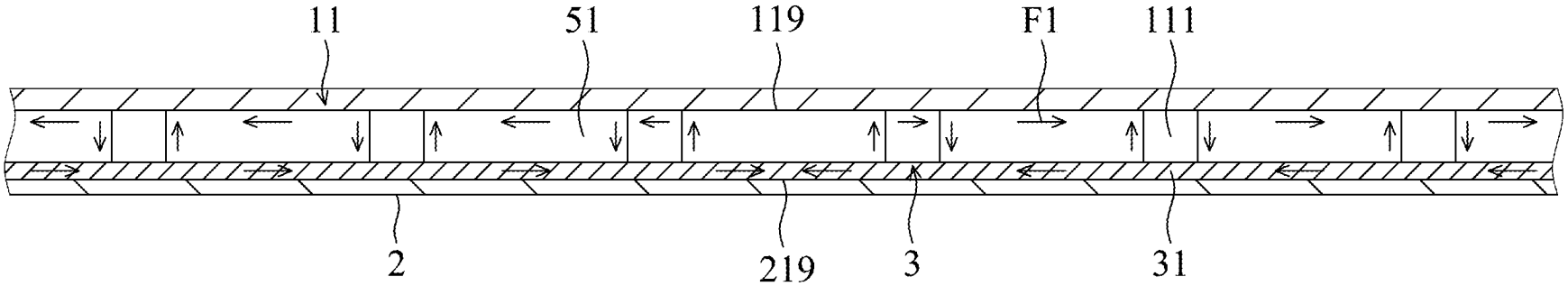
FIG. 2 is a sectional view along I-II direction of FIG. 1A.

FIG. 1A is an exploded view of a slim heat-dissipation module of a first embodiment of the invention. FIG. 1B is an exploded view of the slim heat-dissipation module of the first embodiment of the invention in another view angle. With reference to FIGS. 1A and 1B, the slim heat-dissipation module D1 of the first embodiment of the invention includes a first plate 1, a second plate 2, a vapor chamber unit 3 and a heat pipe unit 4. The first plate comprises a heat pipe area 12 and a vapor chamber area 11. The vapor chamber unit 3 is connected to the vapor chamber area 11. FIG. 2 is a sectional view along II-II direction of FIG. 1A. With reference to FIG. 2, a first type chamber 51 is formed between the vapor chamber unit 3 and the vapor chamber area 11. In this embodiment, the first type chamber 51 is a vapor chamber. In the first type chamber 51, a first fluid F1 transmits heat by radial diffusion.

Figure 3:
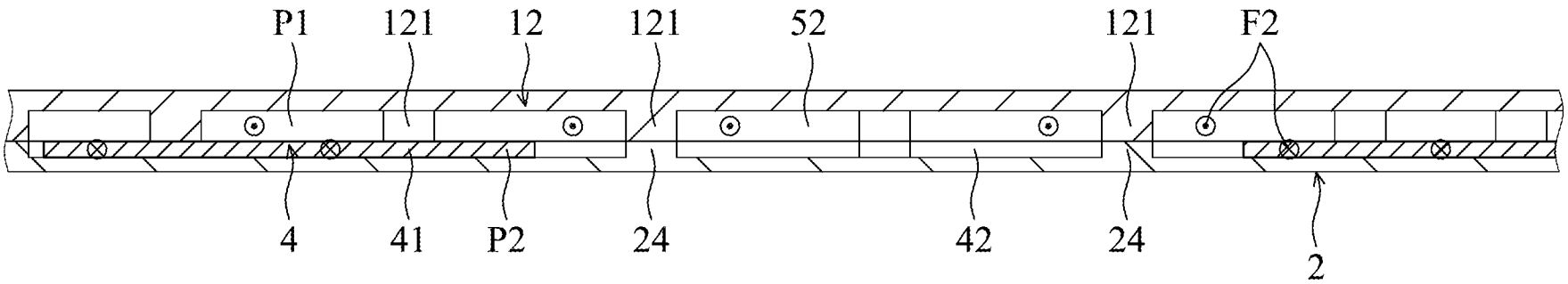
FIG. 3 is a sectional view along III-III direction of FIG. 1A.

With reference to FIGS. 1A and 1B, the heat pipe unit 4 is connected to the heat pipe area 12. FIG. 3 is a sectional view along III-III direction of FIG. 1A. With reference to FIG. 3, a second type chamber is formed between the heat pipe unit 4 and the heat pipe area 12. In this embodiment, the second type chamber 52 is a heat pipe chamber. In the second type chamber 52, a second fluid transmits heat by back-and-forth circulation. The first type chamber 51 and the second type chamber 52 are sealed and independent, respectively.

With reference to FIGS. 1A, 1B and 2, in this embodiment, the vapor chamber area 11 has a condenser-microstructure 111, and the vapor chamber unit 3 has a vapor-microstructure, ie, the first porous structure 31. The vapor-microstructure 31 corresponds to the condenser-microstructure 111. In one embodiment, the condenser-microstructure 111 comprises a plurality of first metal pillars. The vapor-microstructure 31 is a porous structure. The vapor-microstructure 31 sufficiently corresponds to the first metal pillars of the condenser-microstructure 111. Therefore, the vapor chamber area 11 and the vapor chamber unit 3 provide heat dissipation function by passive thermal equilibrium.

With references to FIGS. 1A, 1B and 3, in this embodiment, the heat pipe area 12 has a first circulation structure 121, and the heat pipe unit 4 has a second circulation structure (second porous structure) 41. The first circulation structure 121 and the second circulation structure 41 jointly define a first circulation path P1. A second circulation path P2 is formed inside the second circulation structure 41. When the second fluid F2 is in a first state (a gaseous state), most of the second fluid F2 travels in the first circulation path P1. When the second fluid F2 is in a second state (a liquid state), most of the second fluid F2 travels in the second circulation path P2. In this embodiment, the second circulation structure 41 forms a second circulation groove 42. The first circulation path P1 includes the second circulation groove 42. In this embodiment, the circulation groove 42 is an enclosed groove. The first circulation structure 121 comprises a plurality of second metal pillars. The second circulation structure 41 is a porous structure. The heat pipe area 12 and the heat pipe unit 4 provide heat dissipation function by active thermal equilibrium.

Figure 4:
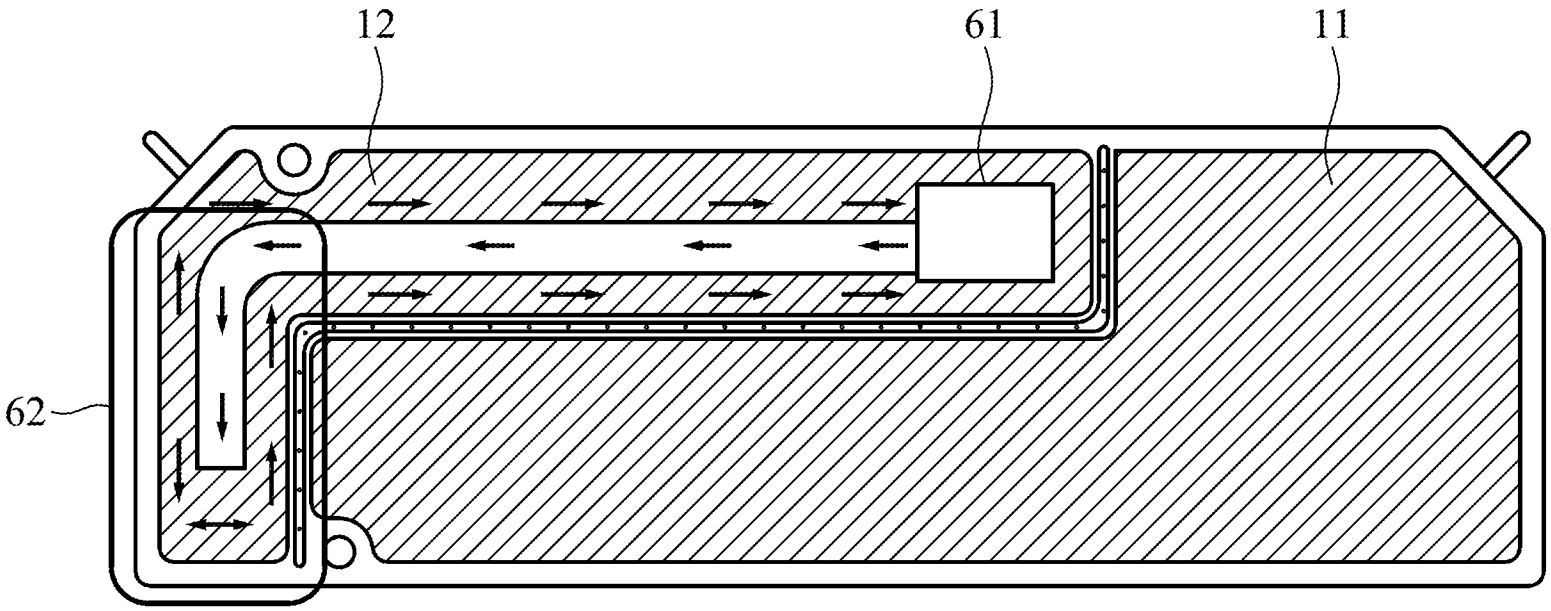
FIG. 4 shows the operation of the slim heat-dissipation module of the embodiments of the invention.

FIG. 4 shows the operation of the slim heat-dissipation module of the embodiments of the invention. With reference to FIG. 4, one end of the heat pipe area 12 and heat pipe unit 4 is thermally connected to a heat source 61 (such as a CPU or other heat source with high temperature), and the other end thereof is thermally connected to a heat sink 62 (such as a cooling fin). The slim heat-dissipation module of the embodiment of the invention performs a heat dissipation function by active thermal equilibrium and passive thermal equilibrium. The heat dissipation efficiency of the product is improved, and the thickness thereof is reduced. Additionally, the heat pipe structure and the vapor chamber structure are integrated on one single first plate, and the manufacturing cost is decreased.

With reference to FIGS. 1A and 1B, in one embodiment, the second plate 2 of the slim heat-dissipation module D1 comprises a first recess 21 and a second recess 22. The vapor chamber unit 3 is disposed inside the first recess 21. The heat pipe unit 4 is disposed in the second recess 22. A spacer 23 is formed between the first recess 21 and the second recess 22. In one embodiment, the second plate 2 further has a supporting structure 24. The supporting structure 24 is formed in the second recess 22. The supporting structure 24 abuts a portion of the first circulation structure 121. In particular, the supporting structure 24 is inserted into the second circulation groove 42 and abuts the first circulation structure 121 (with reference to FIG. 3). In this embodiment, the supporting structure 24 comprises a plurality of third metal pillars. The second metal pillars respectively abut the third metal pillars. The supporting structure 24 abuts a portion of the first circulation structure 121 to increase the strength of the slim heat-dissipation module. In this embodiment, the first plate 1 comprises a condenser-microstructure 111, a first inner surface 119 (in the vaper chamber area 11) and a second inner surface 129 (in the heat pipe area 12), wherein the condenser-microstructure 111 is formed on the first inner surface 119. The second plate 2 comprises a third inner surface 219 (in the first recess 21) and a fourth inner surface 229 (in the second recess 22). The first type chamber is formed between the first inner surface 119 and the third inner surface 219. The second type chamber is formed between the second inner surface 129 and the fourth inner surface 229. The first type chamber is not communicated with the second type chamber. With reference to FIG. 2, the vapor-microstructure 31 is not in contact with the first inner surface 119.

In the embodiment above, the first recess 21 and the second recess 22 can also be formed separately, rather than integrated on one single second plate 2. The disclosure is not meant to restrict the invention.

Figure 5A:
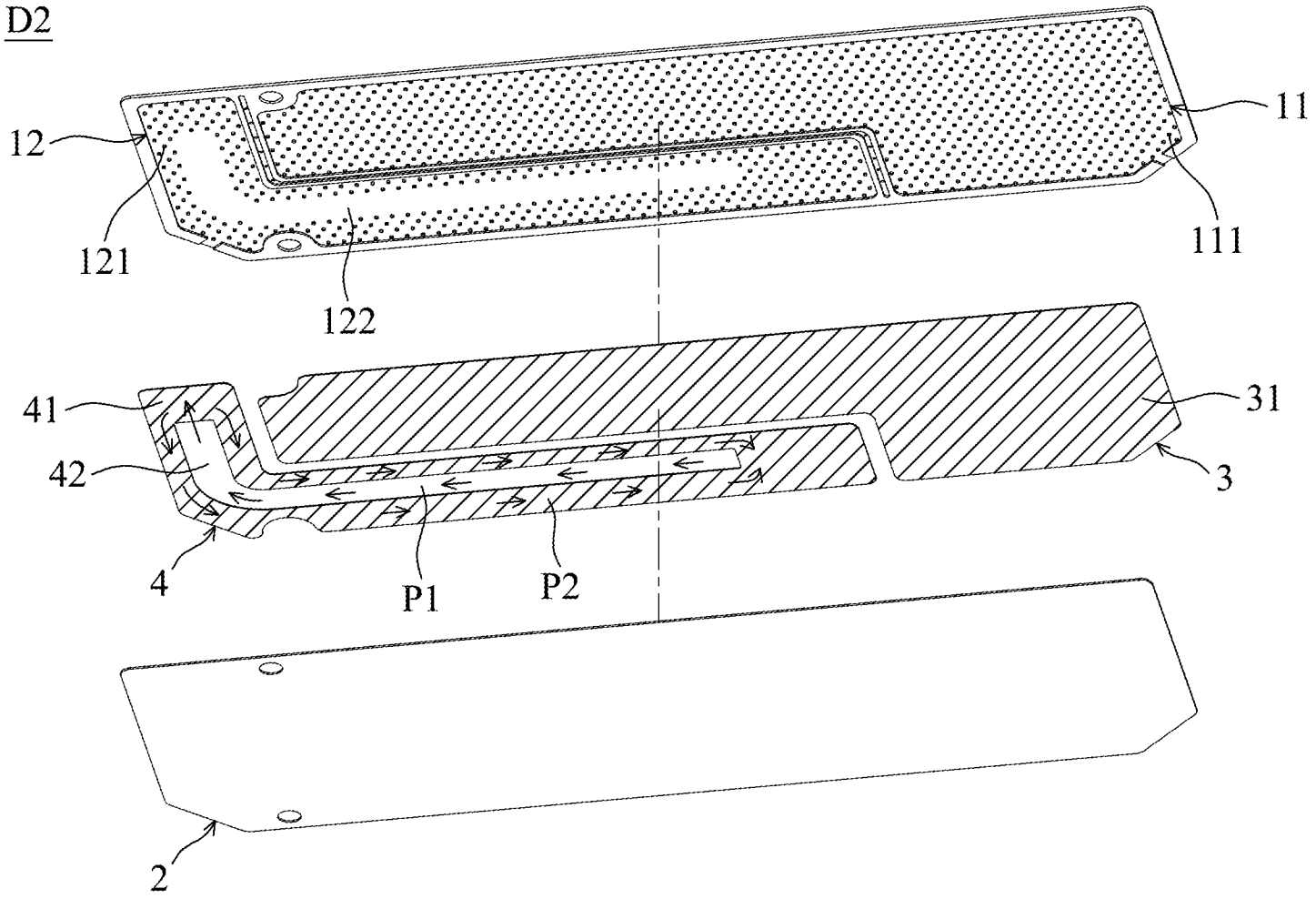
FIGS. 5A and 5B show a slim heat-dissipation module of a second embodiment of the invention.
Figure 5B:
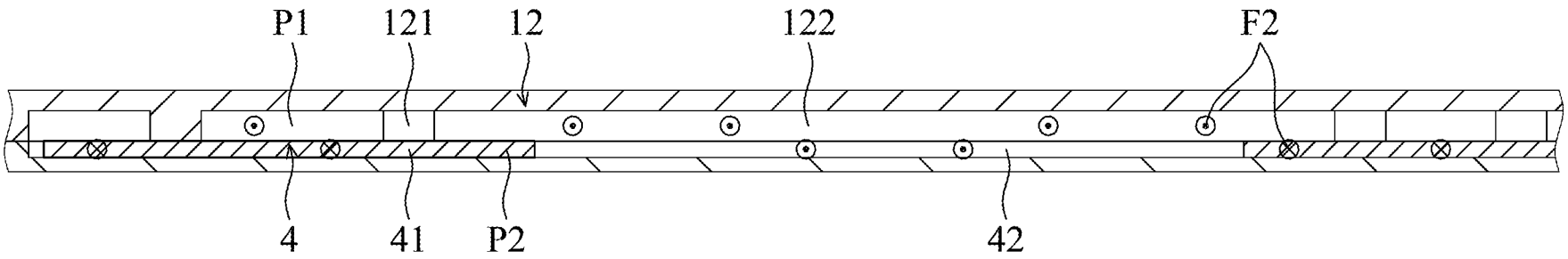

FIGS. 5A and 5B show a slim heat-dissipation module D2 of a second embodiment of the invention. In this embodiment, the second metal pillars arranged to define a first circulation groove 122 (located between the second metal pillars). The first circulation groove 122 corresponds to the second circulation groove 42. The supporting structure mentioned above can also be utilized in this embodiment.

Figure 6A:
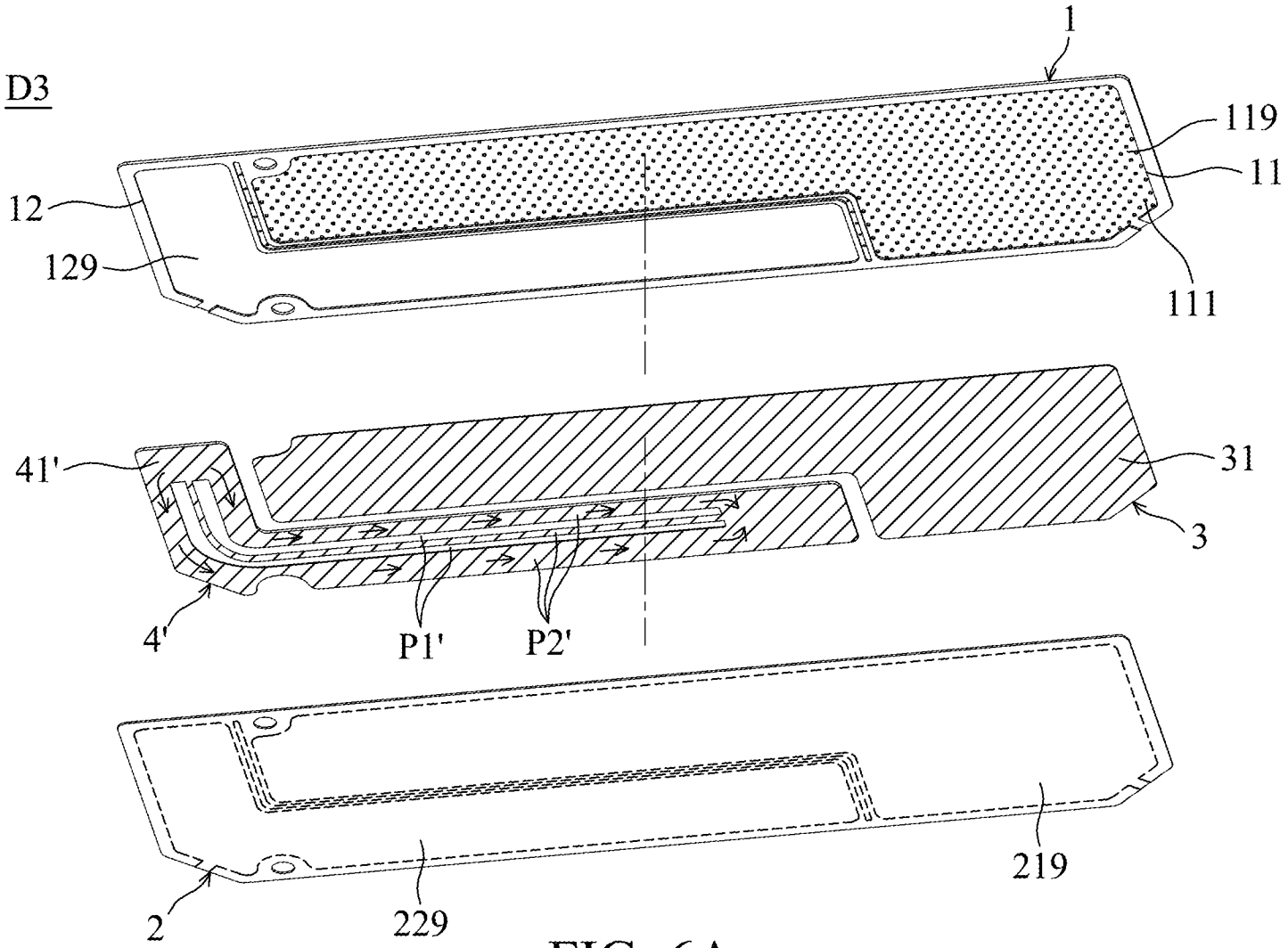
FIGS. 6A and 6B show a slim heat-dissipation module of a third embodiment of the invention.
Figure 6B:
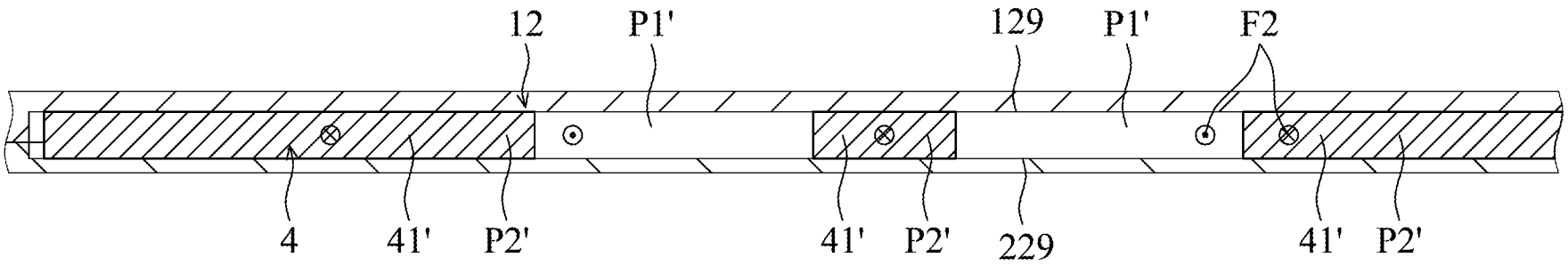

FIGS. 6A and 6B show a slim heat-dissipation module D3 of a third embodiment of the invention. In this embodiment, the first plate 1 comprises the condenser-microstructure 111, the first inner surface 119 (in the vaper chamber area 11) and the second inner surface 129 (in the heat pipe area 12), wherein the condenser-microstructure 111 is formed on the first inner surface 119. The second plate 2 comprises the third inner surface 219 (in the first recess 21) and the fourth inner surface 229 (in the second recess 22). The first type chamber is formed between the first inner surface 119 and the third inner surface 219. The second type chamber is formed between the second inner surface 129 and the fourth inner surface 229. The first type chamber is not communicated with the second type chamber. The vapor chamber unit 4' has a third circulation structure 41'. A first circulation path P1' is defined out of the third circulation structure 41'. A second circulation path P2' is formed in the third circulation structure 41'. When the second fluid F2 is in the first state (a gaseous state), most of the second fluid F2 travels in the first circulation path P1'. When the second fluid F2 is in the second state (a liquid state), most of the second fluid F2 travels in the second circulation path P2'. In this embodiment, the third circulation structure 41' is a porous structure. The third circulation structure 41' has increased height and abuts the heat pipe area. Therefore, the third circulation structure 41' contacts the second inner surface 129 and the fourth inner surface 229.

Utilizing the different embodiments above, the strength of the slim heat-dissipation module can be modified, and the flow rate of the second fluid in different states (a gaseous state and a liquid state) can be modified.

Figure 7:
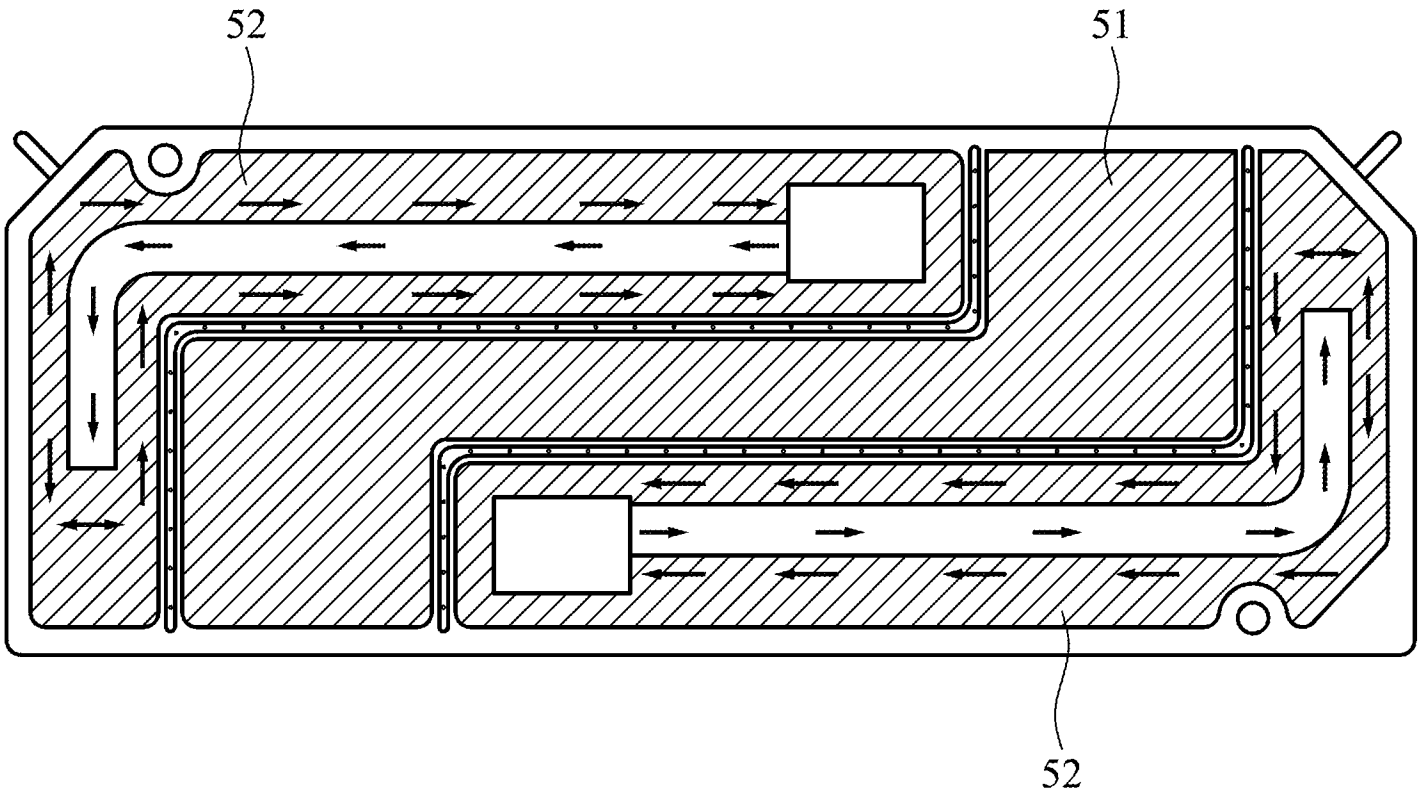
FIG. 7 shows a slim heat-dissipation module of a fourth embodiment of the invention.

With reference to FIG. 7, in one embodiment, the sum of the number of first type chambers 51 and the number of second type chambers 52 is three or a positive integer greater than three. In one embodiment, the number of first type chambers 51 differs from the number of second type chambers 52.

With reference to FIGS. 2 and 3, in one embodiment, the height of the first type chamber 51 differs from the height of the second type chamber 52. In another embodiment, the wall thickness of the first type chamber 51 differs from the wall thickness of the second type chamber 52.

With reference to FIG. 1A, in one embodiment, the first plate 1 or the second plate 2 has at least one through hole (15, 25), blind hole, or protrusion for connecting the system.

In one embodiment, an active heat-dissipation device is disposed out of the first type chamber 51 or the second type chamber 52. The active heat-dissipation device can be a fan.

In another embodiment, the slim heat-dissipation module includes a wall. The wall simultaneously connects to the first plate and the second plate to form a first type chamber and a second type chamber, wherein the first type chamber and the second type chamber are sealed and independent, respectively.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A slim heat-dissipation module, comprising:

a first plate, comprising a plurality of metal pillars, a first inner surface and a second inner surface, wherein the metal pillars are formed on the first inner surface;

a second plate, comprising a third inner surface and a fourth inner surface, wherein the first plate is combined with the second plate, a first type chamber is formed between the first inner surface and the third inner surface, a second type chamber is formed between the second inner surface and the fourth inner surface, and the first type chamber is not communicated with the second type chamber;

a first porous structure, disposed in the first type chamber, wherein the first porous structure contacts the third inner surface, and the first porous structure is not in contact with the first inner surface;

a second porous structure, disposed in the second type chamber, wherein the second porous structure contacts the second inner surface and the fourth inner surface, wherein the second porous structure is a sheet-shaped structure, a circulation groove is formed on the second porous structure, and the circulation groove is a through opening;

a first fluid, disposed in the first type chamber; and a second fluid, disposed in the second type chamber, wherein a first circulation path is defined between the second inner surface and a top surface of the second porous structure, two second circulation paths are formed in the second porous structure, and the two second circulation paths are located on two lateral sides of the circulation groove, wherein when the second fluid is in a gaseous state, most of the second fluid travels in the first circulation path, and when the second fluid is in a liquid state, most of the second fluid travels in the second circulation path, wherein the first circulation path overlaps at least a portion of the second circulation path.

2. The slim heat-dissipation module as claimed in claim 1, wherein the metal pillars abut the first porous structure.

3. The slim heat-dissipation module as claimed in claim 2, wherein the first plate, the first porous structure and the second plate are only vertically stacked.

4. The slim heat-dissipation module as claimed in claim 3, wherein the first plate, the second porous structure and the second plate are only vertically stacked.

5. The slim heat-dissipation module as claimed in claim 1, wherein the first fluid transmits heat by vaporization, and the second fluid transmits heat by back-and-forth circulation.

6. The slim heat-dissipation module as claimed in claim 1, wherein the circulation groove is an L-shaped through opening enclosed by the second porous structure.

* * * * *